United States Patent [19]

Nitta

[11] 4,181,490

[45] Jan. 1, 1980

[54] DISPOSABLE CIGARET LIGHTER WITH SNUFFING COVER

[75] Inventor: Tomio Nitta, Yokohama, Japan

[73] Assignee: Tokai Seiki Co., Ltd., Yokohama, Japan

[21] Appl. No.: 807,534

[22] Filed: Jun. 17, 1977

[30] Foreign Application Priority Data

Jun. 17, 1976 [JP] Japan ..... 51-71548

[51] Int. Cl.[2] ..... F23Q 2/08

[52] U.S. Cl. ..... 431/129; 431/152; 431/277

[58] Field of Search ..... 431/129–131, 431/150–152

[56] References Cited

U.S. PATENT DOCUMENTS

| | | | |
|---|---|---|---|
| 3,055,201 | 9/1962 | Smith | 431/151 |
| 3,161,034 | 12/1964 | Meyers | 431/131 |
| 3,270,528 | 9/1966 | Gevirman et al. | 431/150 |
| 3,286,491 | 11/1966 | Smith | 431/130 |
| 3,290,905 | 12/1966 | Court | 431/150 |
| 3,521,985 | 7/1970 | Chrisman et al. | 431/151 |

FOREIGN PATENT DOCUMENTS

| | | | |
|---|---|---|---|
| 2642480 | 3/1977 | Fed. Rep. of Germany | 431/150 |

*Primary Examiner*—Carroll B. Dority, Jr.
*Attorney, Agent, or Firm*—Gerald J. Ferguson, Jr.; Joseph J. Baker

[57] ABSTRACT

A disposable cigaret lighter has a snuffing cover which is closed when the flame is to be put out. The snuffing cover is provided on the top of the lighter independent of any of the operating members of the lighter such as a nozzle opening lever and a sparking wheel. The snuffing cover may be mounted on the windbreak wall of the lighter slidably or rotatably.

10 Claims, 20 Drawing Figures

DISPOSABLE CIGARET LIGHTER WITH SNUFFING COVER

BACKGROUND OF THE INVENTION

1. Field of the Invention

This invention relates to a cigaret lighter, and more particularly to a disposable cigaret gas fueled lighter with a snuffing cover.

2. Description of the Prior Art

Disposable cigaret lighters having a lighter assembly on a reservoir containing a liquefied inflammable gas are well known and widely used. The disposable lighter carries on the reservoir a flint, a flint holding means, a sparking wheel rotatable by the thumb, a gas outlet nozzle and a nozzle opening lever depressible with the thumb. By depressing the lever with the thumb, the nozzle is opened and the gasified fuel ejects out of the nozzle. Simultaneously, the sparking wheel is rotated to spark the flint to ignite the fuel. Thus, the lighter is ignited by only one action to depress the lever and rotate the sparking wheel.

The above feature of the disposable lighter is very convenient in lighting cigarets. On the other hand, however, since the operation of the disposable lighter is very simple and the disposable lighter is usually carried in the user's pocket, accidents sometimes occur. Such accidents are often caused by the incomplete shut-off of the fuel gas. After the nozzle opening lever is returned to its closed position, the nozzle is sometimes not completely closed. In such case, a small flame remains on the top of the nozzle. The small flame will burn the pocket.

On the other hand, it is well known to provide a closure cap or a cover on the top of the lighter assembly in order to ensure extinguishment of the flame. In conventional lighters with a cap or cover, the cap or cover is connected with the sparking wheel and/or the nozzle opening lever to simplify the lighting operation. Therefore, it may easily happen that the cap or cover is opened and the nozzle is opened, or the cap or cover is opened and the sparking wheel is rotated. It may possibly happen that the cap or cover is opened sparking the flit and the nozzle is opened as well. Occurences of this type result from the structure of the lighter wherein the cap or cover is interconnected with the nozzle opening lever and/or the sparking wheel.

From the viewpoint of safety, however, it is undesirable that the cover be connected with other operating means to simplify the lighting action. Further, from the viewpoint of economy which is of great concern in the disposable cigaret lighter, the structure of the lighter is desired to be as simple as possible.

SUMMARY OF THE INVENTION

It is therefore the primary object of the present invention to provide a disposable cigaret lighter with a snuffing cover which is of simple structure and does not have means for interconnecting the cover with other operating means.

It is another object of the present invention to provide a disposable cigaret lighter with a snuffing cover in which the snuffing cover is provided independently of either the nozzle opening lever or the sparking wheel.

It is still another object of the present invention to provide a disposable cigaret lighter with a snuffing cover in which the snuffing cover is made to be easily opened with the thumb.

It is a further object of the present invention to provide a disposable cigaret lighter with a snuffing cover in which the snuffing cover is so shaped as to prevent the nozzle opening lever from being depressed when the cover is closed.

The above objects of the invention are accomplished by providing on the top of the disposable cigaret lighter a snuffing cover which is movable between a closed position and an opened position independently of the nozzle opening lever or the sparking wheel. The snuffing cover completely extinguishes the flame when closed. Therefore, it is assured that the lighter flame is completely put out. Further, since the cover is independent of the other operating means, inadvertent lighting is prevented. Thus, an economical and highly safe disposable lighter can be obtained.

DESCRIPTION OF THE PREFERRED EMBODIMENTS

Figure 1:
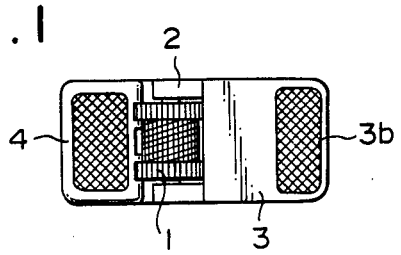
FIG. 1 is a plan view of an embodiment of the present invention.
Figure 2:
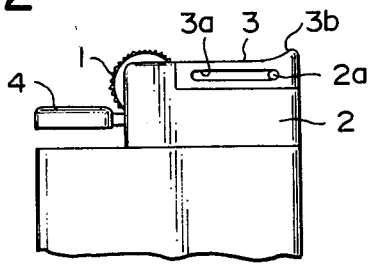
FIG. 2 is a partial side view of the embodiment of the invention as shown in FIG. 1 wherein the snuffing cover is closed.
Figure 3:
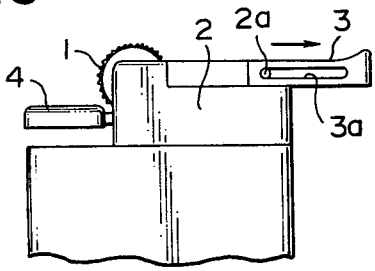
FIG. 3 is a partial side view of the embodiment of the invention as shown in FIG. 1 wherein the snuffing cover is opened.
Figure 4:
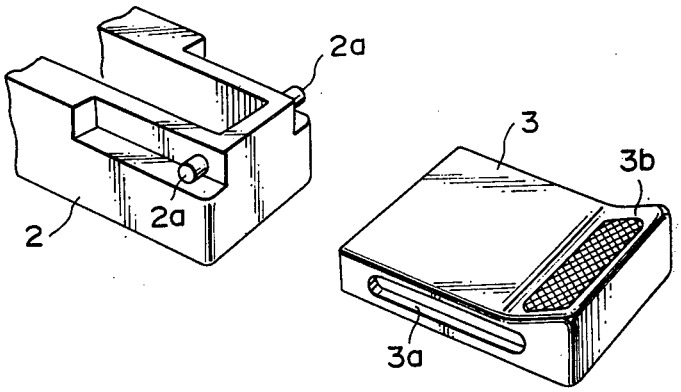
FIG. 4 is a partial exploded perspective view of the embodiment as shown in FIGS. 1 to 3, FIGS. 5 to 8 are views similar to FIGS. 1 to 4 respectively of another embodiment of the invention wherein the snuffing cover is made obliquely slidable up and down.
Figure 5:
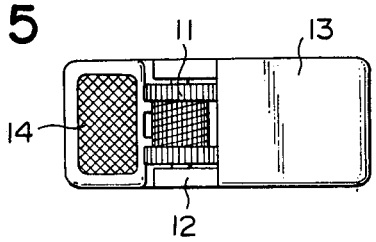
Figure 6:
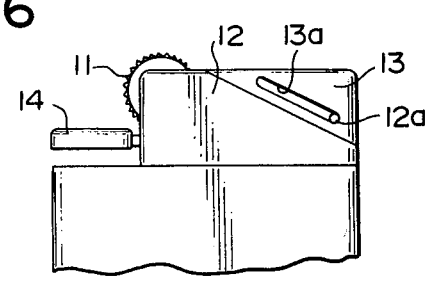
Figure 7:
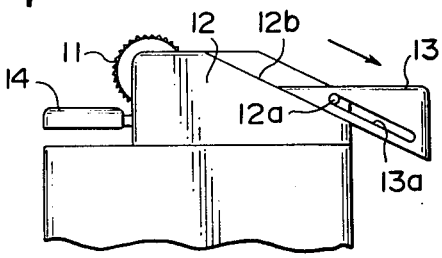
Figure 8:
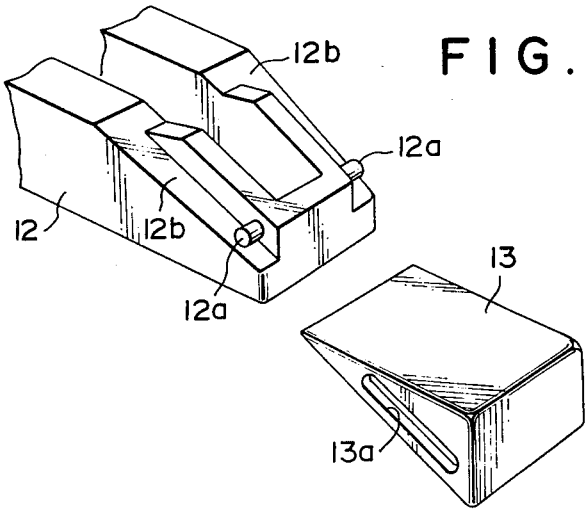
Figure 9:
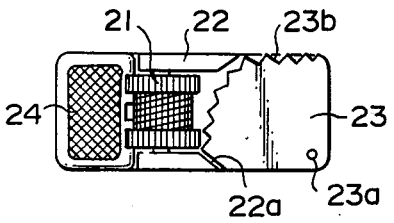
FIGS. 9 to 12 show still another embodiment of the invention in which the snuffing cover is pivotally mounted on the top of the lighter to rotate in a horizontal plane.

A first embodiment of the invention will be described in detail hereinbelow with reference to FIGS. 1 to 4. A sparking wheel 1 is rotatably supported in a windbreak wall 2. On the windbreak wall 2 is slidably mounted a slidable snuffing cover 3. The cover 3 has a pair of slots 3*a*, one on either side thereof, which are slidably engaged with a pair of guide pins 2*a* fixed to the windbreak wall 2. The snuffing cover 3 is made of a heat resistive plastic material or metal of sufficient resiliency to maintain it in open position by the contact between the edges of the slots 3*a* and the pins 2*a*. The slidable snuffing cover 3 has a thumb portion 3*b* to facilitate the sliding of the cover 3. When the cover 3 is to be opened the thumb (or one of the fingers) is engaged with the thumb portion 3*b* and the cover 3 is slid open. Then, the sparking wheel 1 is rotated and a nozzle opening lever 4 is depressed with the thumb.

A second embodiment of the invention will now be described in detail with reference to FIGS. 5 to 8. In this invention also, a slidable snuffing cover 13 having a pair of slots 13*a* is slidably mounted on a windbreak wall 12 having a pair of guide pins 12*a* on the opposite sides thereof. The windbreak wall 12 has oblique guide faces 12*b* on the opposite sides thereof. The sparking wheel and the nozzle opening lever are designated by the reference numerals 11 and 14, respectively.

In the above described two embodiments shown in FIGS. 1 to 4 and 5 to 8, the slidable snuffing cover 3 or 13 has a pair of slots and the windbreak wall 2 or 12 has a pair of pins. The slots and pins may be, however, be provided the other way around.

Figure 10:
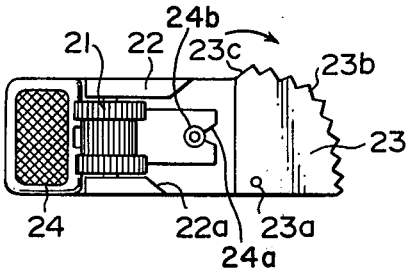
Figure 11:
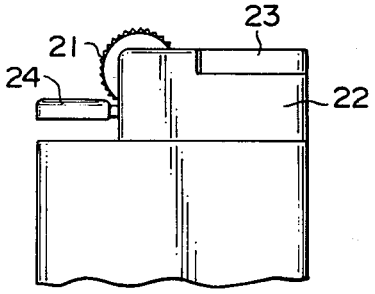
Figure 12:
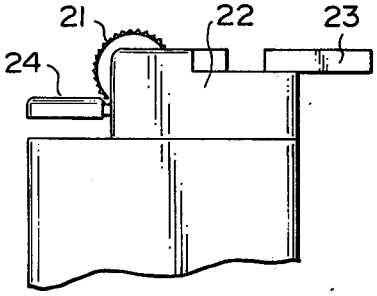

A third embodiment will be described referring to FIGS. 9 to 12. On a windbreak wall 22 is pivotally mounted a snuffing cover 23. The snuffing cover 23 is pivotally mounted on the upper end of the windbreak wall 22 by a pivot pin 23*a* and has a thumb edge 23*b* on the side thereof so as to be easily rotated by the thumb or a finger. The windbreak wall 22 has a stopper 22*a* on a part thereof to limit rotation of the cover 23 by abutting against an end 23*c* of the cover 23 as shown in FIG. 10. The sparking wheel and the nozzle opening lever are designated by the reference numerals 21 and 24, respectively, in this embodiment. The lever 24 has a forked end 24*a* and is horizontally pivoted at an intermediate portion thereof with respect to windbreak wall 22. Nozzle 24*b* includes a neck or groove which engages the forked end of lever 24 so that the nozzle may be raised or lowered to open an interior valve and permit the passage of gas through the nozzle.

Figure 13:
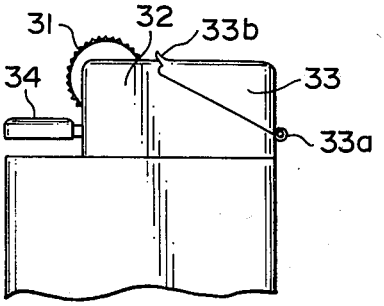
FIGS. 13 and 14 are side views showing still another embodiment of the invention in which the snuffing cover is hinged to the top of the lighter.
Figure 14:
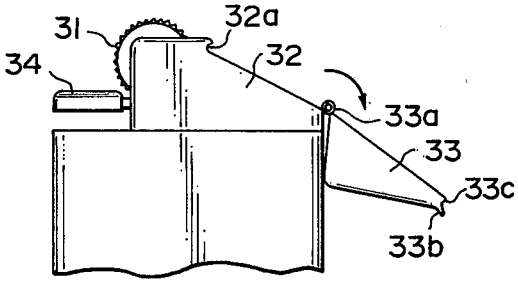

A fourth embodiment of the invention will be described referring to FIGS. 13 and 14. A hinged snuffing cover 33 is provided on a windbreak wall 32. The windbreak wall 32 has an obliquely cut away portion where the hinged cover 33 engages. The hinged cover 33 is hinged at a hinge 33*a* located on the right side (in FIGS. 13 and 14) of the windbreak wall 32. The cover 33 further has a thumb portion 33*b* at an end thereof as shown. The sparking wheel and the nozzle opening lever are designated by the reference numerals 31 and 34, respectively. In this embodiment, the thumb opens the hinged cover 33 by engaging the thumb portion 33*b*. The windbreak wall 32 is provided with a catch 32*a* to engage one end of the hinged cover 33 to click hold the hinged cover 33 in its closed position.

Figure 15:
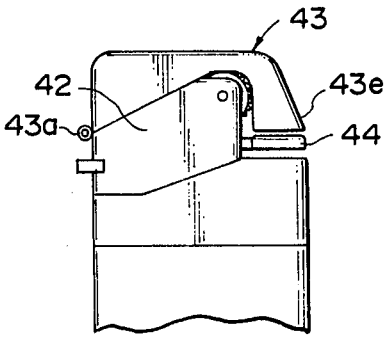
FIGS. 15 to 17 show still another embodiment of the invention in which the snuffing cover has a nozzle cap and a lever depression preventing portion.
Figure 16:
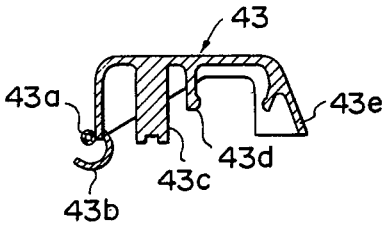
Figure 17:
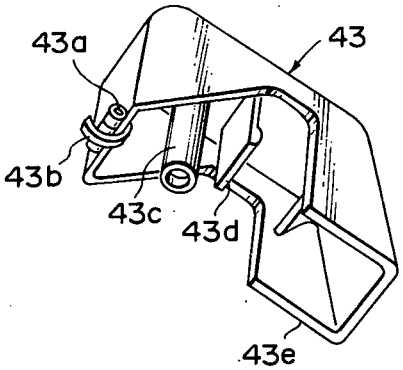

A fifth embodiment of the invention will be described referring to FIGS. 15 to 17. A hinged snuffing cover 43 is mounted on a windbreak wall 42 by means of a hinge 43*a*. The snuffing cover 43 has a portion 43*e* for preventing depression of a nozzle opening lever 44. The snuffing cover 43 further has, as shown in FIGS. 16 and 17, a spring 43*b* integrally molded with the cover body to spring-urge the cover 43 into its open position. The spring 43*b* is fixed integrally to the cover 43 near the hinge 43*a*. The cover 43 further has a snuffing projection 43*c* extending inward from the interior thereof to directly close the gas outlet of the nozzle of the lighter (not shown). The cover 43 also has an engaging projection 43*d* extending inward from the interior thereof to engage the serrated periphery of the sparking wheel to snap holding the cover 43 on the sparking wheel. When the hinged cover 43 is pushed down onto the top of the lighter, the engaging projection 43*d* engages the sparking wheel and the cover 43 is held in its closed position as shown in FIG. 15. In this position the portion 43*e* for preventing depression of the nozzle opening lever 44 covers the lever 44 to prevent the lever 44 from being depressed manually or inadvertently. Reference should be made to the description of the embodiment of FIGS. 9 to 12 for an explanation of the operation of the nozzle under the control of nozzle opening lever 44.

Since the above described fifth embodiment has a cover 43 which has a snuffing projection 43*c* which comes in direct contact with the gas outlet of the nozzle, the small flame remaining on the gas outlet is completely put out by closing the cover 43. When the cover 43 is to be opened, a part thereof is pushed upward with the thumb or a finger. Once the cover 43 is opened, it is spring-urged by spring 43*b* to stay in its open position.

Figure 18:
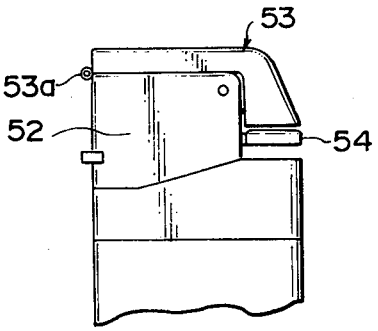
FIGS. 18 to 20 show still another embodiment of the invention in which the snuffing cover has a lever depression preventing portion.
Figure 19:
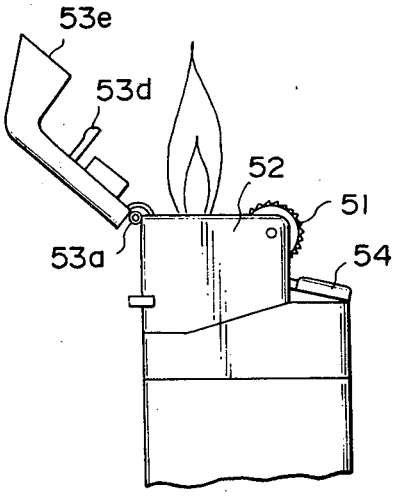
Figure 20:
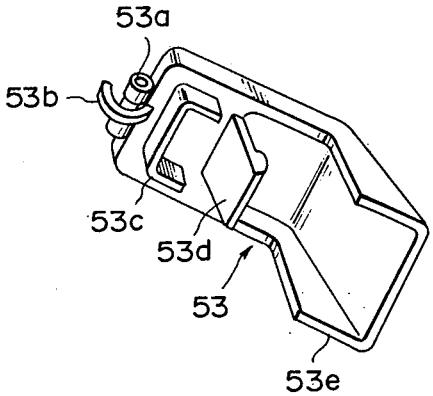

A sixth embodiment of the invention will now be described with reference to FIGS. 18 to 20. A hinged cover 53 is mounted on a windbreak wall 52 by means of a hinge 53*a*. The hinged cover 53 has a spring 53*b*, an engaging projection 53*d* and a lever depression preventing portion 53*e* similarly to the aforesaid embodiment shown in FIGS. 15 to 17. In this embodiment, the cover 53 does not have a snuffing projection but has a snuffing rib 53*c* which is fixed to the inside face of the cover 53. The rib 53*c* effectively closes off the space within the windbreak wall 52 from above to put out the flame.

I claim:

1. A disposable cigaret lighter having a lighter assembly on a reservoir containing a liquefied fuel gas, said lighter assembly including a windbreak wall, a gas outlet nozzle with a valve provided on the reservoir surrounded by said windbreak wall, a nozzle opening lever engaged with the nozzle for opening said valve to cause the fuel gas to eject out of said nozzle, a sparking wheel, and a flint urged to be in frictional engagement with the sparking wheel, wherein the improvement comprising a snuffing cover mounted on said windbreak wall, said snuffing cover being rotatably mounted on said windbreak wall and movable between a closed position to close the upper opening of the wall and an open position to be retracted from the upper opening of the wall, the operation of said nozzle opening lever and said sparking wheel being independent of the movement of said snuffing cover between said closed position and said open position, and said snuffing cover having a catch to be snap-engaged with the sparking wheel.

2. A disposable cigaret lighter as defined in claim 1 wherein said snuffing cover is pivotally mounted on said windbreak wall.

3. A disposable cigaret lighter as defined in claim 1 wherein said snuffing cover is hinged on the windbreak wall.

4. A disposable cigaret lighter as defined in claim 1 wherein said snuffing cover has a portion to prevent the nozzle opening lever from being depressed when said snuffing cover is in said closed position.

5. A disposable cigaret lighter as defined in claim 4 wherein said snuffing cover has a nozzle closing projection which is put into direct contact with the gas outlet opening of the nozzle when the snuffing cover is in said closed position.

6. A disposable cigaret lighter as defined in claim 1 wherein said snuffing cover has a nozzle closing projection which is put into direct contact with the gas outlet opening of the nozzle when the snuffing cover is in said closed position.

7. A disposable cigaret lighter as defined in claim 1 wherein said snuffing cover has a portion to prevent the nozzle opening lever from being depressed when said snuffing cover is in said closed position.

8. A disposable cigaret lighter as defined in claim 7 wherein said snuffing cover has a nozzle closing projection which is put into direct contact with the gas outlet opening of the nozzle when the snuffing cover is in said closed position.

9. A disposable cigaret lighter as defined in claim 7 wherein said snuffing cover has a nozzle closing rib which is put into direct contact with the gas outlet opening of the nozzle when the snuffing cover is in said closed position.

10. A disposable cigaret lighter as defined in claim 1 wherein said snuffing cover has a nozzle closing rib which is put into direct contact with the gas outlet opening of the nozzle when the snuffing cover is in said closed position.

* * * * *